US007572190B2

(12) United States Patent
Habing

(10) Patent No.: US 7,572,190 B2
(45) Date of Patent: Aug. 11, 2009

(54) SINGLE RIDER TEETER-TOTTER

(75) Inventor: Theodore G. Habing, Tustin, CA (US)

(73) Assignee: Dream Visions, LLC, Tustin, CA (US)

( * ) Notice: Subject to any disclaimer, the term of this patent is extended or adjusted under 35 U.S.C. 154(b) by 0 days.

(21) Appl. No.: 11/473,636

(22) Filed: Jun. 23, 2006

(65) Prior Publication Data

US 2007/0298944 A1 Dec. 27, 2007

(51) Int. Cl.
*A63G 11/00* (2006.01)

(52) U.S. Cl. ..... 472/110; 472/112; 482/123; 482/130

(58) Field of Classification Search ..... 482/123, 482/95, 130, 96, 100, 137; 472/106, 107, 472/108, 109, 110, 111, 112, 113, 114, 115, 472/135

See application file for complete search history.

(56) References Cited

U.S. PATENT DOCUMENTS

| | | | | | |
|---|---|---|---|---|---|
| 43,972 | A | * | 8/1864 | Coldwell | 297/195.11 |
| 76,053 | A | * | 3/1868 | Coldwell | 297/195.11 |
| 82,992 | A | * | 10/1868 | Rich | 297/195.11 |
| 217,918 | A | * | 7/1879 | White | 482/130 |
| 232,217 | A | * | 9/1880 | Tuttle | 482/96 |
| 458,136 | A | * | 8/1891 | Wilder | 472/110 |
| 819,878 | A | * | 5/1906 | Grindy | 297/181 |
| 847,787 | A | * | 3/1907 | Kyle | 472/112 |
| 935,854 | A | * | 10/1909 | Linerode | 472/108 |
| 1,060,590 | A | | 5/1913 | Donnenwerth | |
| D55,572 | S | | 6/1920 | Peterson | |
| 1,408,670 | A | * | 3/1922 | Williams | 472/104 |
| 1,432,746 | A | * | 10/1922 | Downey | 472/4 |
| 1,435,585 | A | * | 11/1922 | Coleman | 472/104 |
| 1,461,631 | A | * | 7/1923 | Smerechanski | 472/113 |
| 1,488,808 | A | * | 4/1924 | Dove | 472/110 |
| 1,527,015 | A | * | 2/1925 | Sedlacek | 472/110 |
| 1,533,261 | A | * | 4/1925 | Pattison et al. | 472/110 |
| 1,550,040 | A | * | 8/1925 | Nagy | 472/112 |
| 1,553,520 | A | * | 9/1925 | Dougherty | 472/104 |
| 1,577,037 | A | * | 3/1926 | Kocher | 472/105 |
| 1,578,852 | A | * | 3/1926 | Schmutzer | 472/104 |
| 1,580,508 | A | | 4/1926 | Liles | |
| 1,586,254 | A | * | 5/1926 | Lovejoy | 472/110 |
| 1,598,512 | A | * | 8/1926 | Taylor | 248/584 |
| 1,600,362 | A | * | 9/1926 | Reid | 297/174 R |
| 1,635,931 | A | * | 7/1927 | Free | 472/110 |
| 1,640,150 | A | * | 8/1927 | Henry et al. | 472/110 |
| 1,677,531 | A | * | 7/1928 | Shanton | 297/313 |
| 1,850,927 | A | | 3/1932 | Frederick | |
| 1,898,466 | A | * | 2/1933 | Pierson | 472/112 |
| 1,961,796 | A | * | 6/1934 | Shuster | 472/104 |
| RE19,327 | E | * | 9/1934 | Shuster | 472/104 |
| 1,992,127 | A | * | 2/1935 | Mariowe | 472/99 |
| 2,050,500 | A | * | 8/1936 | Osborn | 472/99 |
| 2,107,448 | A | * | 2/1938 | Marlowe | 472/99 |

(Continued)

*Primary Examiner*—Loan H Thanh
*Assistant Examiner*—Daniel F Roland
(74) *Attorney, Agent, or Firm*—Blakely, Sokoloff, Taylor & Zafman LLP

(57) ABSTRACT

A safer, more user-friendly spring-balance single-rider teeter-totter includes manual adjustments for both the vertical position of the spring, which adjusts the rest height of the seat, and the horizontal position of the spring from the pivot, which adjusts the counterbalance resistance. A safety cover may be provided for the spring or other counterbalance mechanism.

12 Claims, 2 Drawing Sheets

U.S. PATENT DOCUMENTS 2,130,438 A * 9/1938 Westerlund ..... 248/594
2,198,947 A * 4/1940 Olson ..... 472/112
2,201,036 A 5/1940 Guerrier
2,252,008 A 8/1941 Joncas
2,325,988 A * 8/1943 Thomas ..... 446/173
2,398,122 A 4/1946 Souza
2,457,627 A * 12/1948 Bailey ..... 472/110
2,509,796 A 5/1950 Bailey
2,527,763 A * 10/1950 Probst ..... 472/4
2,542,359 A * 2/1951 Rocklin ..... 472/110
2,544,106 A * 3/1951 Ray ..... 472/110
2,704,111 A * 3/1955 Wunderlich ..... 297/274
2,735,679 A * 2/1956 Mortenson ..... 472/4
3,046,011 A * 7/1962 Songer ..... 472/113
3,117,780 A * 1/1964 Gregory ..... 472/113
3,140,869 A * 7/1964 Pacuk ..... 472/110
3,298,685 A * 1/1967 Williams ..... 472/16
3,420,522 A * 1/1969 Elliott ..... 472/110
3,472,507 A * 10/1969 Michel ..... 472/114
3,514,103 A * 5/1970 Lieberman ..... 472/110
3,638,941 A * 2/1972 Kulkens ..... 482/113
3,721,437 A * 3/1973 Skaricic ..... 482/68
3,860,226 A * 1/1975 Hensiek, Jr. ..... 267/69
3,968,962 A 7/1976 Atkins et al.
4,226,411 A 10/1980 Manus
4,351,522 A 9/1982 Marburger et al.
4,582,319 A * 4/1986 Luna ..... 482/130
4,591,150 A * 5/1986 Mosher ..... 482/125
4,632,390 A * 12/1986 Richey ..... 482/96
4,693,468 A * 9/1987 Kurlytis et al. ..... 482/62
5,002,271 A * 3/1991 Gonzales ..... 482/130
5,435,798 A * 7/1995 Habing et al. ..... 482/5
5,527,248 A * 6/1996 Crivello ..... 482/96
5,547,425 A * 8/1996 Krhs et al. ..... 472/110
5,547,443 A * 8/1996 Chen ..... 482/72
5,569,124 A * 10/1996 Raynie et al. ..... 482/44
5,605,524 A * 2/1997 Husted ..... 482/112
5,616,109 A * 4/1997 Szu-Ming ..... 482/123
5,624,353 A * 4/1997 Naidus ..... 482/5
5,951,406 A * 9/1999 Steane ..... 472/111
6,202,263 B1 * 3/2001 Harker ..... 24/300
6,872,145 B1 3/2005 Boudreaux et al.
7,278,958 B2 * 10/2007 Morgan ..... 482/97
7,452,311 B2 * 11/2008 Barnes et al. ..... 482/96
2006/0128482 A1 * 6/2006 Habing ..... 472/113
2007/0037679 A1 * 2/2007 Geeting ..... 482/130
2007/0232468 A1 * 10/2007 Levy et al. ..... 482/121

* cited by examiner

SINGLE RIDER TEETER-TOTTER

BACKGROUND OF THE INVENTION

1. Field of the Invention

This invention relates to field of amusement devices, particularly teeter-totters. Specifically, the invention relates to a spring balanced single rider teeter-totter.

2. Background

Teeter-totters, also known as seesaws, have long been popular items of playground equipment for children. Teeter-totters come in various configurations, but most are fundamentally similar. In the most basic configuration, a teeter-totter can be simply a plank supported near its center for pivotal movement.

A variation of the conventional two-rider teeter-totter is one adapted for use by a single rider. One-sided, single-rider teeter-totters typically consist of a pivoting seat with a counterbalance, such as a spring, to balance the rider's weight. The rider rides up and down on the seat in a bouncing manner against the elastic resistance of the spring or other counterbalance device. An early version of a single rider teeter-totter is shown in U.S. Pat. No. 1,586,254. This device has a board with a seat at one end and a pivot near the opposite end. A spring is attached at the extreme opposite end of the board to balance the rider's weight. The height of the pivot and, indirectly, the counterbalancing effect of the spring is adjusted by raising or lowering a pair of threaded boards that support the pivot. This is a cumbersome adjustment and weakens the structural integrity of the frame. Furthermore, there is no direct adjustment for the resistance of the spring, nor is there any safety cover for the spring.

Other prior art single rider teeter-totters, including, for example, the device shown in U.S. Pat. No. 3,968,962, disclose adjustments for the spring resistance, that require that the spring or springs be repositioned. The adjustment process requires that the seat be lifted to release any tension and that the spring then be disconnected and reattached at a different location. In some of the prior art devices, the spring or springs must be moved from one detent to another, or the point of attachment of the spring must be slid along a track. These prior art methods of adjusting the spring tension are both cumbersome and dangerous. If the springs become detached or dislocated during use of the teeter-totter, the counterbalancing force may be reduced or eliminated altogether causing the rider to strike the ground forcibly and unexpectedly. Furthermore, fingers can be easily pinched while manually adjusting the springs.

SUMMARY OF THE INVENTION

The present invention provides a safer, more user-friendly single rider teeter-totter. Manual adjustments are provided for both the vertical position of the spring, which adjusts the rest height of the seat, and the horizontal position of the spring from the pivot, which adjusts the counterbalance resistance. Adjustments are accomplished with lead screw mechanisms, which provide virtually infinite adjustment within the travel of the screw and which remain in a selected position without the need for locks or detents. Other embodiments may include a locking slide mechanism that positively locks in defined detent positions. A safety cover may be provided for the spring or other counterbalance mechanism. Indicators are provided for visual reference of the adjustments.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
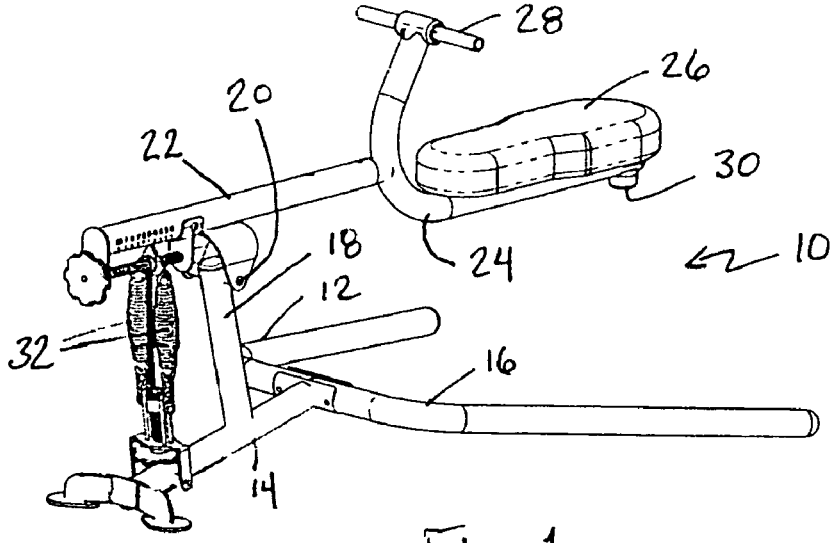
FIG. 1 is a perspective view of a single rider teeter-totter in accordance with an embodiment of the present inventions.

FIG. 1 is a perspective view of a single rider teeter-totter 10 in accordance with an embodiment of the present invention. A frame 12 comprises forward support member 14 and generally U-shaped rear support member 16. The frame further comprises pivot support post 18 with pivot assembly 20 attached at the top thereof. Longitudinal beam 22 is coupled to pivot assembly 20. Seat support member 24 is attached to beam 22. The various components of frame 12 may be fabricated from tubular steel as is common for exercise and playground equipment, although other materials may be used if desired.

Seat 26 is attached to seat support member 24. Seat 26 may be constructed of a molded foam or plastic material. A handle bar 28 is attached to the upper portion of seat support member 24. The weight of a rider in the seat 26 is counterbalanced by springs 32. A pair of springs is used in parallel so that if one of the springs fails, the second spring will still provide half of the counterbalancing force to prevent the teeter-totter from falling uncontrollably. In the event of a spring failure, or if the spring resistance is not properly adjusted, or if the rider is simply overly exuberant, impact with the ground is cushioned by bumper 30 attached to seat support member 24. Furthermore, the design of generally U-shaped rear support member 16 ensures that the rider will not contact any of the frame members at the bottom limit of travel and also eliminates pinch points in the vicinity of the seat.

Figure 2:
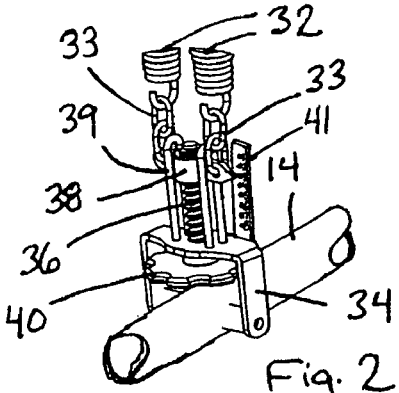
FIG. 2 is a detailed view of the height adjustment for the counterbalance mechanism.

FIG. 2 illustrates the spring height adjustment mechanism, which sets the rest height of the seat and thereby also acts as a range of travel adjustment. This mechanism adjusts the lower attachment point of springs 32 and thereby adjusts the height of seat 26 off of the ground. Yoke 34 is attached to forward support member 14 and carries adjustment screw 36. The lower ends of springs 32 are attached with chain links 33 to follower 38, which is threadably engaged on adjustment screw 36 and slides within guides 39. Knob 40 is used to manually rotate adjustment screw 36, thereby raising or lowering follower 38. A numerical indicator 41 may be provided to assist riders in setting the seat height at a desired level.

Guides 39 prevent twisting of the springs 32 as the vertical position of follower 38 is adjusted. This type of a lead screw adjustment mechanism provides virtually infinite adjustment within the travel of follower 38 on screw 36 and remains in a selected position without the need for any additional locking or detent mechanism.

The chain links 33 constitute flexible couplings that communicate tensile forces, but not compressive forces. As the rider approaches the top of the range of movement, the springs become fully relaxed and the chain links allow for continued upward movement. The rider thus experiences a free-floating or weightless sensation at the top of the range of movement.

Figure 3:
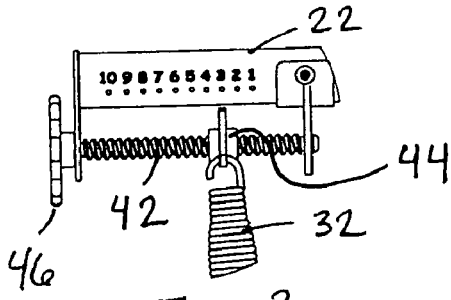
FIG. 3 is a detailed view of the position adjustment for the counterbalance mechanism.

FIG. 3 is a detailed view of the counterbalance adjustment mechanism. Adjustment screw 42 is suspended below beam 22. The upper ends of springs 32 are attached to follower 44, which is threadably engaged on adjustment screw 42. Knob 46 is used to manually rotate adjustment screw 42, thereby moving follower 44 fore and aft in relation to beam 22. When follower 44 is moved closer to pivot 20, the effective resistance of springs 32 is reduced, which is desirable for use of the apparatus by a lighter rider. Conversely, a heavier rider would turn knob 46 to move follower 44 further away from pivot 20, thereby increasing the effective resistance of springs 32. A numerical indicator may be provided on beam 22 as illustrated to assist riders in setting the effective resistance to a desired value.

Figure 4:
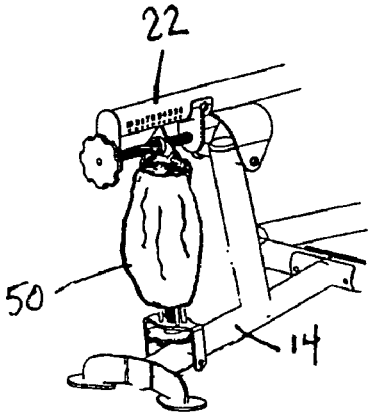
FIG. 4 is a detailed view of an optional shroud for the counterbalance mechanism.

FIG. 4 shows an optional elastic shroud 50 that surrounds the springs 32. This protects children from having their fingers or other parts of their bodies pinched by the springs as they stretch and relax.

Figure 5:
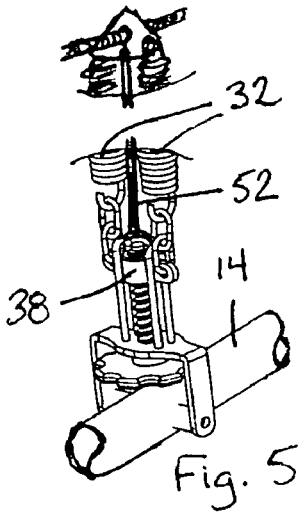
FIG. 5 is a detailed view of an optional secondary elastic counterbalance.

FIG. 5 shows an optional secondary counterbalance 52. This may be an elastic cord that provides additional counterbalancing force in the event that one or both of the springs breaks. Cord 52 is coupled in parallel with the springs 32 and may be threaded though the center of one of the springs if desired. Cord 52 could also be inelastic to serve as a safety tether to stop the downward movement of the seat before it strikes the ground.

Figure 6:
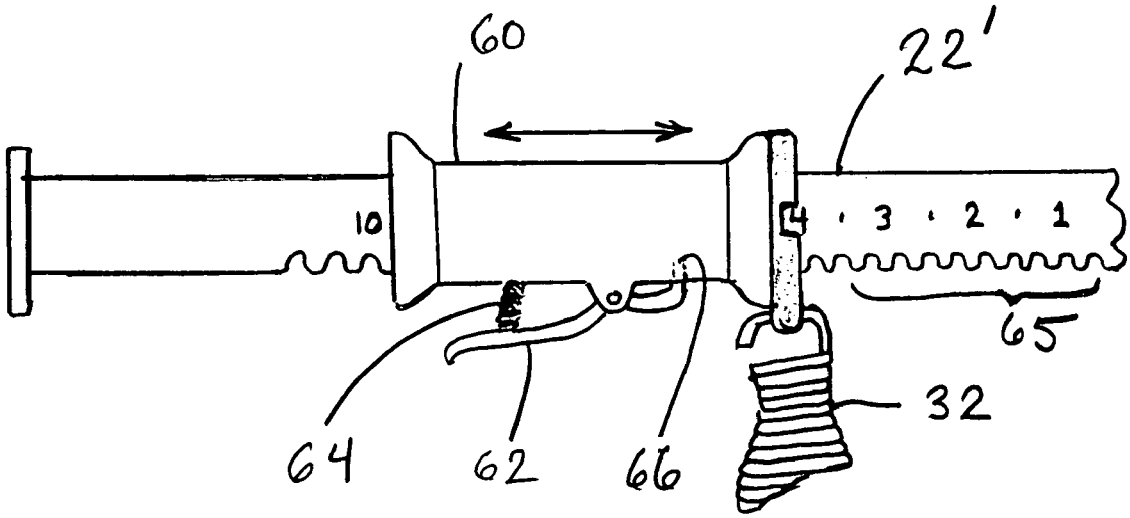
FIG. 6 is a detailed view of an alternative position adjustment for the counterbalance mechanism.

FIG. 6 shows an alternative counterbalance adjustment mechanism. Here, longitudinal beam 22' is notched with detents 65 along a portion of its length. Springs 32 are attached to slider 60, which rides along beam 22' and is configured to be gripped by hand. A trigger 62 is pivotally attached to slider 60 and is biased towards an engaged position by spring 64. Squeezing trigger 62 releases detent lock 66 from engagement with detent 65 and allows slider 60 to be moved forward or rearward to a desired position. As in the previously described embodiment, a numerical indicator may be provided on beam 22' as illustrated to assist riders in setting the effective resistance to a desired value.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A play apparatus comprising: a support frame adapted to rest on a floor; a seat; a longitudinal beam member pivotally coupled to the support frame, the seat disposed at a first end of the beam member; a spring coupled at a first end thereof to the beam member; a manually operated adjustment member for adjusting a coupling position of the spring longitudinally with respect to the beam member; an adjustment screw coupled to the frame; a threaded follower disposed on the adjustment screw, wherein the spring is coupled at a second end thereof to the threaded follower; a knob attached to the adjustment screw, whereby manual rotation of the knob moves the follower toward or away from the frame and thereby adjusts a rest height of the seat; wherein the adjustment member is constrained against displacement from the beam member at all times, including during adjustment, whereby the spring remains engaged between the beam member and the support frame at all times; and wherein movement of the follower toward or away from the frame vertically displaces the follower with respect to the floor.

2. The play apparatus of claim 1 wherein the spring is one of two springs coupled in parallel.

3. The play apparatus of claim 1 further comprising an indicator to provide a visual reference for adjustment of the counterbalance mechanism.

4. The play apparatus of claim 1 further comprising an indicator to provide a visual reference for adjustment of the seat height using the knob.

5. The play apparatus of claim 1 further comprising a guide to prevent rotation of the follower.

6. The play apparatus of claim 1 further comprising a secondary counterbalance device.

7. The play apparatus of claim 6 wherein the secondary counterbalance device comprises an elastic member coupled in parallel with the spring.

8. The play apparatus of claim 1 further comprising a safety shroud surrounding the spring.

9. The play apparatus of claim 1 wherein the spring is coupled to the follower by at least one chain link.

10. The play apparatus of claim 1 wherein the coupling position of the spring with respect to the beam member is threadably or slidably adjustable.

11. The play apparatus of claim 10 wherein the adjustment screw for adjusting the rest height of the seat is a first adjustment screw and wherein the adjustment member for adjusting a coupling position of the spring with respect to the beam member comprises a second adjustment screw.

12. The play apparatus of claim 1 wherein the adjustment member is configured to be operated with a manually operated adjustment knob.

* * * * *